US005423644A

United States Patent [19]

First, Sr.

[11] Patent Number: 5,423,644

[45] Date of Patent: Jun. 13, 1995

[54] CARGO TIE-DOWN HAVING MECHANICAL ADVANTAGE

[75] Inventor: Richard C. First, Sr., Newbury, Ohio

[73] Assignee: R.C. First Enterprises, Inc., Chagrin Falls, Ohio

[21] Appl. No.: 102,563

[22] Filed: Aug. 5, 1993

[51] Int. Cl.[6] ..... A44B 21/00; B65B 11/00

[52] U.S. Cl. ..... 410/100; 24/68 CD

[58] Field of Search ..... 410/100, 103, 12, 11, 410/10, 23; 24/68 R, 68 CD, 68 CT, 69 ST, 69 CT, 69 T, 70 CT, 70 ST, 71 ST

[56] References Cited

U.S. PATENT DOCUMENTS

| | | | |
|---|---|---|---|
| 3,478,394 | 11/1969 | Davis | 24/69 CT X |
| 4,823,443 | 4/1989 | Waters | 24/68 CD |
| 5,063,641 | 11/1991 | Chuan | 410/100 X |
| 5,173,996 | 12/1992 | Chou | 410/100 X |
| 5,193,955 | 3/1993 | Chou | 410/100 |

OTHER PUBLICATIONS

Firstline Catalog, R.C. First Enterprises, Inc., Feb. 14, 1992.

*Primary Examiner*—Michael S. Huppert
*Assistant Examiner*—James Eller
*Attorney, Agent, or Firm*—Calfee Halter & Griswold

[57] ABSTRACT

A cargo tie-down device in one embodiment includes hooks and/or loops for connection to the vehicle, a buckle assembly comprising a pair of buckles, and straps which extend through the buckles and interconnect the hooks and/or loops. The straps extend a plurality of times between the buckles to provide a mechanical advantage for the tie-down device. Loops or handles on the straps allow the user to easily pull a take-up strap to initially take in the slack in the strap, and then to pull a winch strap to tightly secure the tie-down device over the load. Releasable cam locking mechanisms on the buckles normally engage the straps during the tightening process, but can be manually manipulated to release the straps to remove the tie-down device from the vehicle. In a second embodiment, the tie-down device comprises a pair of hooks for connection to the vehicle, a single buckle, and a strap which extends through the buckle and interconnects the hooks. The strap again extends a plurality of times between the buckle and one hook to provide a mechanical advantage. The buckle in the second embodiment also includes a releasable cam locking mechanism which normally engages the strap but can be manually manipulated out of engagement with the strap.

12 Claims, 6 Drawing Sheets

CARGO TIE-DOWN HAVING MECHANICAL ADVANTAGE

FIELD OF THE INVENTION

The invention relates generally to devices which facilitate securing cargo during transit or movement, namely cargo tie-downs, hold-downs and/or lashing straps.

BACKGROUND OF THE INVENTION cargo tie-downs (also called "hold-downs" or "lashing straps") are well known. These devices typically include a strap, cord or band having a hook or loop at each end which enables the device to be connected to appropriate structure on a vehicle (or trailer). The strap, cord or band is tensioned across the load to secure the load to the vehicle. Some of these devices are elastic (e.g., a "bungee cord"), while others are substantially inelastic and include a ratchet, gear set, or buckle which allows the length of the strap to be varied to secure the load on the vehicle.

One type of ratchet tie-down device is available from the assignee of the present invention under the mark-/designation 46259 Heavy Duty Tie-Down. This device includes a strap having a first hook at one end, and a handle or loop at the other end. The strap extends around a block (i.e., a bar or rod) located within a buckle, which itself is connected by a short strap to a second hook. The first and second hooks can be secured to appropriate structure on the vehicle or trailer and the handle/loop can be pulled by the user to tighten down the strap. The buckle includes a locking ratchet with teeth which grab the strap and prevent the strap from slipping around the block while in its tightened position. A finger button on the buckle can be manipulated to disengage the locking ratchet from the strap and allow the strap to be released or lengthened.

Applicant believes that the above-described devices, such as the ratchet tie-down device, typically only use a single ratchet, gear set or buckle to vary the length of the strap. While the single ratchet, gear set, or buckle can be effective for securing some loads on a vehicle, in some situations it can be desirable to have additional tension on the load which cannot be achieved using these devices. This is in part believed due to the known devices not providing a mechanical advantage to the strap when tightened. The single buckle, gear set or ratchet only has a single block for the strap between the end hooks, and otherwise does not increase the user's mechanical advantage during the tie-down process (i.e., these devices have a 1:1 mechanical advantage). Moreover, some of these devices, and in particular the ratchet-type devices, actually have a decreasing mechanical advantage as the device is being tightened, which makes it even more difficult to tighten the device as the strap is pulled.

Accordingly, applicant believes that there is a demand in the market for a tie-down device having a mechanical advantage which can be easily and effectively tightened down over a load such that the load can be securely fastened to a vehicle or trailer.

SUMMARY OF THE INVENTION

The present invention provides a new and useful cargo tie-down device which provides a constant mechanical advantage such that a load can be tightly secured to a vehicle. The cargo tie-down device is simple and easy to use, is constructed from commercially-available parts, and can be assembled to provide a 2:1, 3:1, or more, mechanical advantage for the user.

According to one embodiment of the present invention, the tie-down device includes hooks and/or loops for connection to the vehicle, a buckle assembly comprising a pair of buckles, and straps which extend through the buckles and interconnect the hooks and/or loops.

Preferably, a first hook in the tie-down device is connected by a take-up strap to a first buckle in the buckle assembly. The take-up strap extends through a block in the first buckle and terminates in a handle or loop. The block includes a cam locking mechanism which releasably engages the strap within the buckle and prevents the strap from moving around the block, but which can be manually manipulated to release the strap.

According to a first aspect of this embodiment, a second hook, loop and/or handle is connected by a short strap to a ring. A third strap is then connected to a second buckle in the buckle assembly and extends through the ring to a connection with the first buckle. Finally, a winch strap extends from a connection on the second buckle, around a first block in the first buckle, around a second block in the second buckle, and terminates in a loop or handle. The block in the second buckle also has a cam locking mechanism which releasably engages the winch strap as it passes around the second block.

According to another aspect of the first embodiment, the third strap can extend directly from the connection with the second buckle through the second hook to the connection with the first buckle. The third strap passes freely through an eyelet formed in the second hook.

According to either aspect described above, the tie-down device is initially secured to the vehicle by attaching the hooks or loops to appropriate structure on the vehicle with the straps extending over the load. The loop on the take-up strap is grasped and pulled by the user to take up the slack in this strap. The loop on the winch strap is then pulled to tighten down the tie-down device securely across the load. The mechanical advantage provided by the buckle assembly provides increased tension compared to previously known devices to securely fasten the load to the vehicle. The cam locking mechanisms on the buckles normally engage the straps during the tightening process to prevent the straps from slipping, but can be manually manipulated for a controlled release of straps to remove the tie-down device from the vehicle. The tie-down device of the first embodiment provides a constant 3:1 mechanical advantage for the user.

According to a second embodiment of the present invention, the tie-down device comprises a pair of hooks for connection to the vehicle, a single buckle, and a strap which extends through the buckle and interconnects the hooks. The strap is connected at one end to the first hook, extends freely through an eyelet in the second hook, extends around a block in the first buckle, and terminates in a loop or handle. In the second embodiment of the invention, the buckle also includes a releasable cam locking mechanism which normally engages the strap as it passes over the block in the buckle to prevent the strap from slipping, but which can be manually manipulated out of engagement with the strap so that the strap is released.

When connecting the tie-down device of the second embodiment to a vehicle, the hooks are initially attached to appropriate structure on the vehicle with the strap extending over the load. Thereafter, the loop on the strap is grasped and pulled to tighten down the slack in the strap and to securely tighten the tie-down device across the load. The releasable cam locking mechanism can be manually manipulated to release the strap to remove the tie-down device from the vehicle. The tie-down device of the second embodiment provides a constant 2:1 mechanical advantage for the user.

Accordingly, in both embodiments described above, the tie-down device of the present invention easily and effectively tightens down across a load to securely fasten the load to a vehicle.

DETAILED DESCRIPTION OF THE PREFERRED EMBODIMENT

Figure 1:
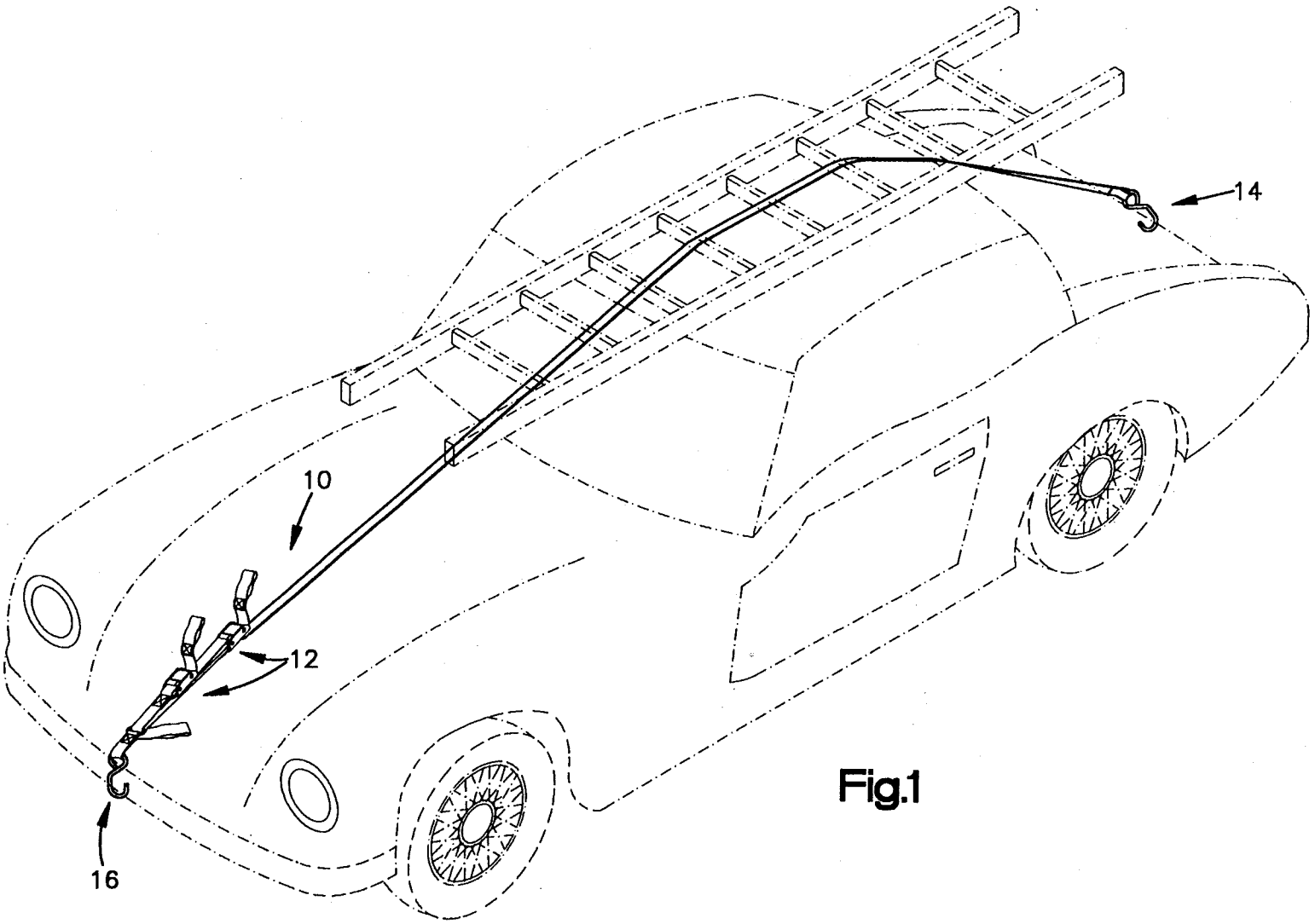
FIG. 1 is a perspective view of the tie-down device constructed according to a first embodiment of the present invention, shown connected across a cargo load on a vehicle (shown in phantom)

Referring to the drawings, the present invention comprises a tie-down device, indicated generally at 10, for securing a load (shown in phantom) to a vehicle (also shown in phantom), or for use in other appropriate situations. As will be described herein in more detail, the tie-down device 10 provides a mechanical advantage which enables the tie-down device to be used to securely fasten the load to the vehicle with an increased amount of tension.

According to a first embodiment of the invention illustrated in FIGS. 1–7, the tie-down device includes a buckle assembly, indicated generally at 12, disposed between and interconnecting a first hook, indicated generally at 14, and a second hook, indicated generally at 16. The hooks are preferably formed from 8 mm plated steel and can be dipped or covered with a layer of rubber to prevent damage to the vehicle.

Figure 2:
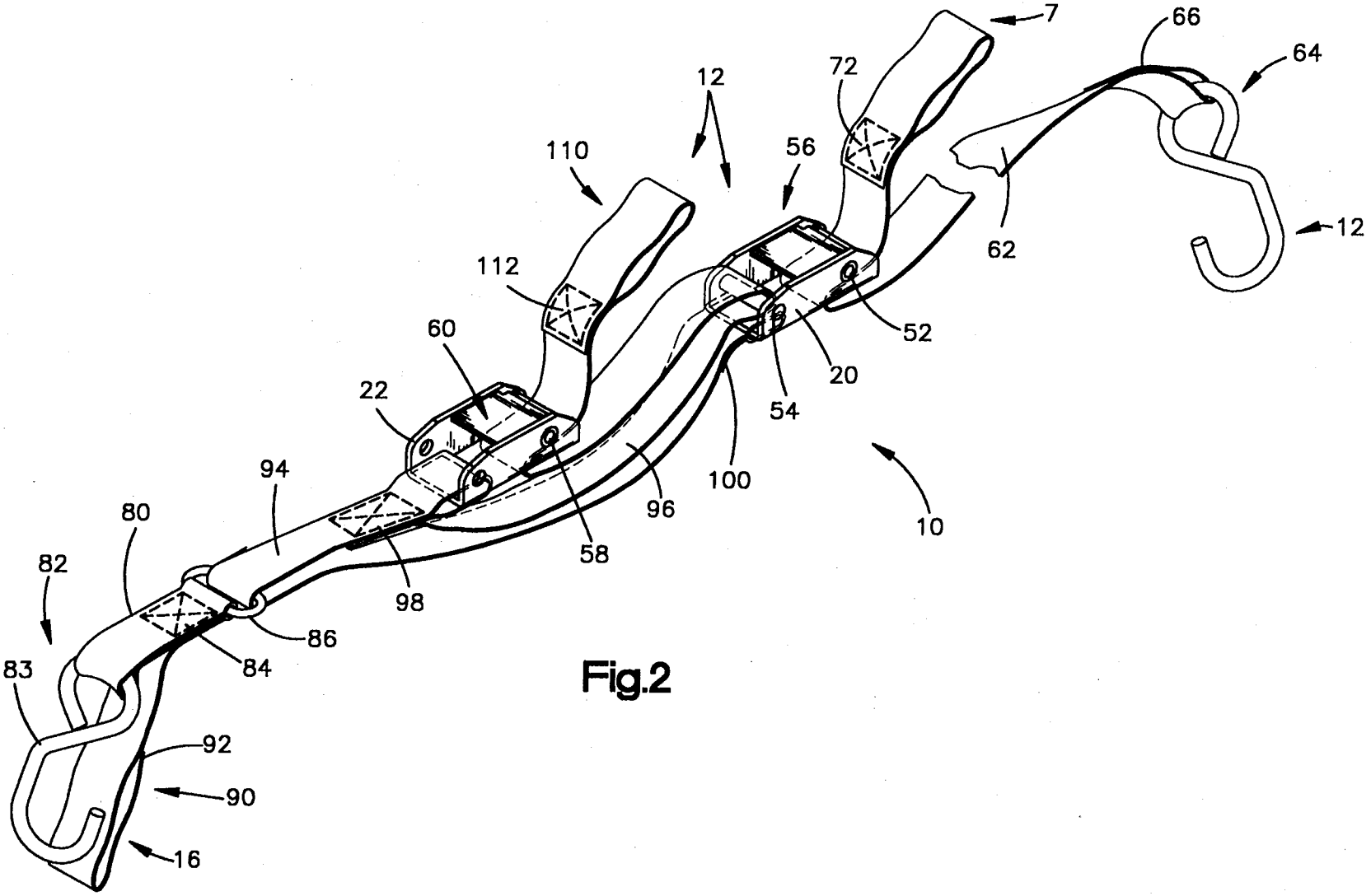
FIG. 2 is an enlarged, perspective view of the tie-down device of FIG. 1.
Figure 3:
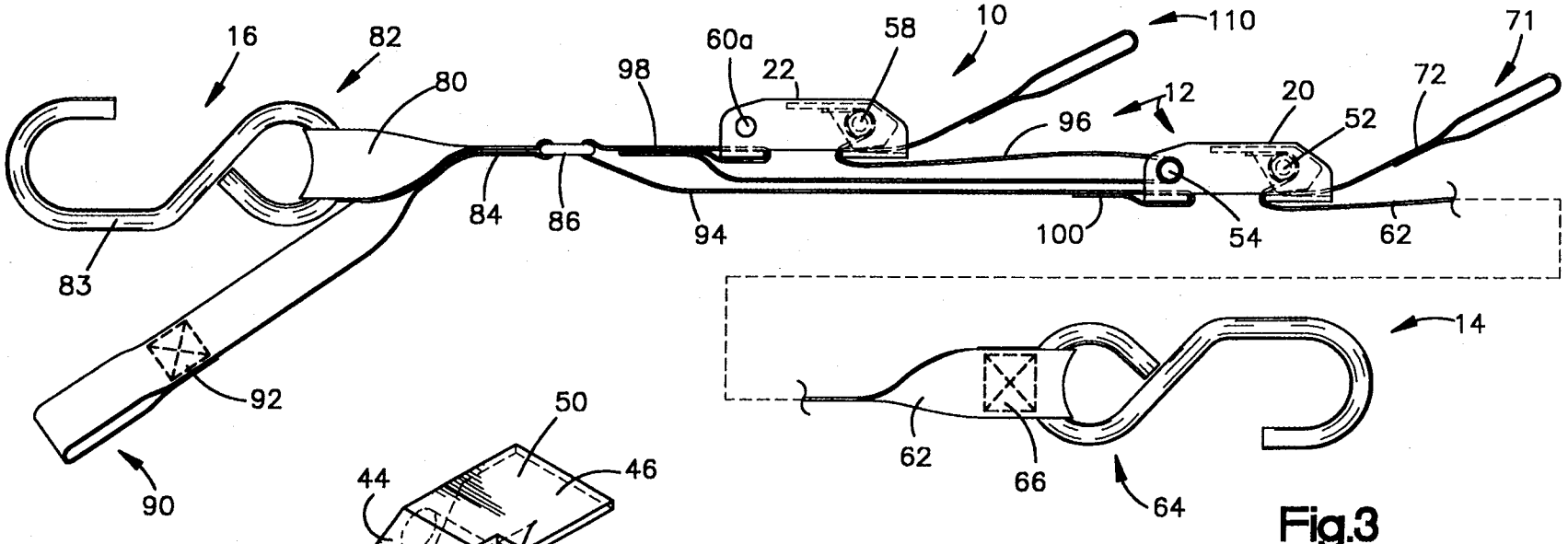
FIG. 3 is a side view of the tie-down device of FIG. 1, with portions shown in cross-section.
Figure 4:
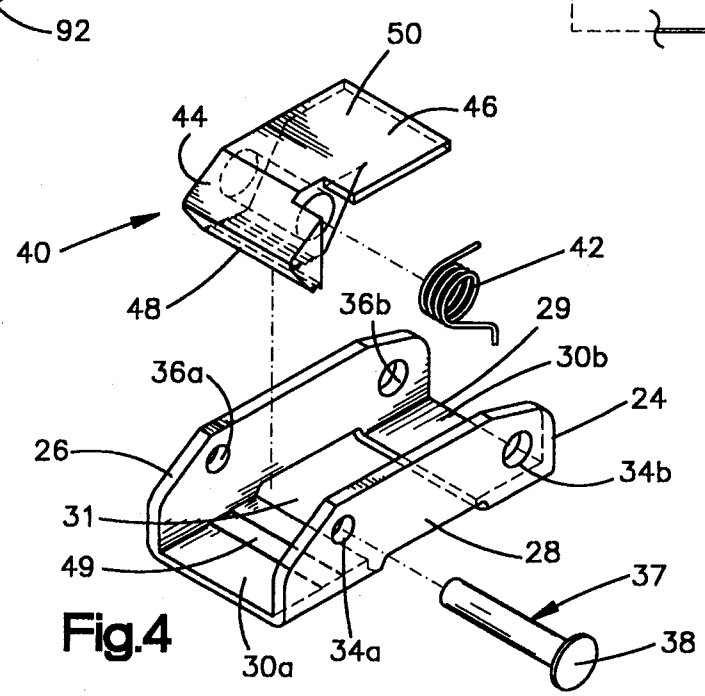
FIG. 4 is an unassembled perspective view of a buckle for the tie-down device.

Referring now in particular to FIGS. 2 and 3, the buckle assembly 12 includes a first take-up buckle 20 and a second winch buckle 22, both of which preferably have substantially the same structure, and hence can be easily formed using the same components. In particular, as illustrated in FIG. 4, each buckle preferably includes a steel or aluminum outer housing 24, having parallel side walls 26, 28, interconnected by a bottom plate 29. The bottom plate 29 of the buckle comprises a pair of flanges **30*a*, 30*b*, which extend between and interconnect the side walls 26, 28 and define a central, relatively square opening, indicated generally at 31. A pair of round apertures are also formed in each side wall, with opposing apertures being designed to receive a "block", i.e., a steel bar, rod, pin, rivet or roller. For example, side wall 28 includes apertures 34*a*, 34*b*, while side wall 26 includes corresponding apertures 36*a*, 36*b*, respectively. A block, indicated generally at 37, is inserted through opposing apertures 34*a*, 36*a*, and includes a head 38 at one end, and a bolt or nut (not shown) received or formed at the other end for securing the block between the two side walls. A similar block (not shown) can be inserted through the other opposing pair of apertures 34*b*, 36*b***, if necessary.

A quick-release locking mechanism or catch can be assembled integrally with each buckle. The locking mechanism preferably includes a cam-shaped locking button, indicated generally at 40, which is located on block 37 and is normally biased by spring 42 into an engaged or locked position. The button 40 includes a central bore 44 formed therethrough which is designed to receive and enable pivotal movement of the button on block 37. Button 40 further includes rows of serrated teeth 48 on the bottom, projecting surface thereof, which are biased downwardly by spring 42 into substantial engagement with bottom plate 29. Corresponding serrated teeth or raised edges 49 can be formed on the inside surface of bottom plate 29 adjacent the serrated teeth on the locking button.

As will be described herein in more detail, when a strap is located between the serrated teeth 48 and the bottom plate 29 of the buckle, the serrated teeth engage the strap, pivot the locking button downwardly against the strap, and prevent relative movement of the strap in the reverse direction (i.e., in a direction which would release the strap). An outwardly-extending release button or flange 50 on the locking button can be manually manipulated by the user (i.e., pressed down into the buckle) to pivot the cam-shaped locking button against its spring bias out of engagement with the strap to release the strap and allow movement thereof. The buckle construction described above is simple and easy to manufacture, is generally resistant to dirt, fluids and other elements, and provides consistent operating results over the useful life of the tie-down device.

It should be realized upon reading the foregoing description, that by using common components for the buckles in the buckle assembly, various buckle designs can be easily created for use with the present invention. For example, the first take-up buckle 20 preferably includes a first bar or rivet 52 extending through one opposing pair of apertures formed in the side walls of the buckle, and a second bar or roller 54 extending between and interconnecting the other opposing pair of apertures formed in the side walls. A plastic roller sleeve (not shown) can be received over roller 54 if desired to reduce chafing and friction over the roller. A locking mechanism, indicated generally at 56, is located around the first bar or rivet 52, and includes a release button 57 and a spring 58, such as described previously.

Figure 6:
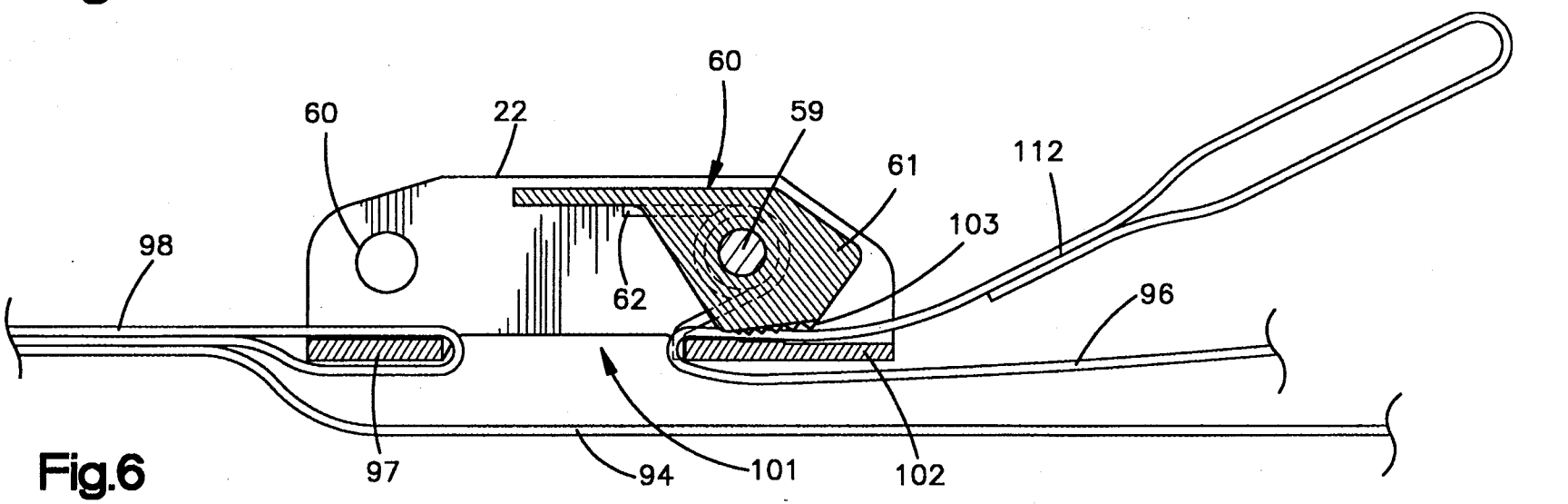
FIG. 6 is an enlarged cross-sectional view of the second buckle for the tie-down device of FIG. 1.

Referring now to FIG. 6, the second winch buckle 22 preferably includes a first bar 59 extending between and interconnecting a first opposing pair of apertures formed in the side walls of the buckle. A locking mechanism, indicated generally at 60, is located around the first bar 59; and includes a release button 61 and a spring 63, such as described previously. The second pair of apertures (one of which is indicated at 60*a*) are preferably not used in the second buckle 22).

As shown in FIGS. 2 and 3, the buckles 20, 22 are interconnected by straps to provide a mechanical advantage between the first hook 14 and the second hook 16. The term "straps" as used herein is intended to encompass other (typically) flat strips or thongs of flexible material which can be used for securing or holding together the hooks, e.g., bands, belts, thongs, ties, cords (elastic or non-elastic), tethers, chains, etc. Other strap-like devices can also be used with the present invention as should also be apparent to those skilled in the art. In short, the term "strap" is intended to encompass all such alternative embodiments useful with the present invention.

According to this embodiment, a first, take-up strap 62 extends between the first hook 14 and the first buckle 20. The take-up strap 62 preferably comprises a one inch wide nylon web which is one-sixteenth of an inch thick and has a 4000 lb. test. Strap 62 extends through and is connected about a ring or eyelet, indicated generally at 64, formed in hook 14. To this end, the strap 62 can be folded over on itself and fastened flush against itself at 66, such as by stitching or adhesive.

Figure 5:
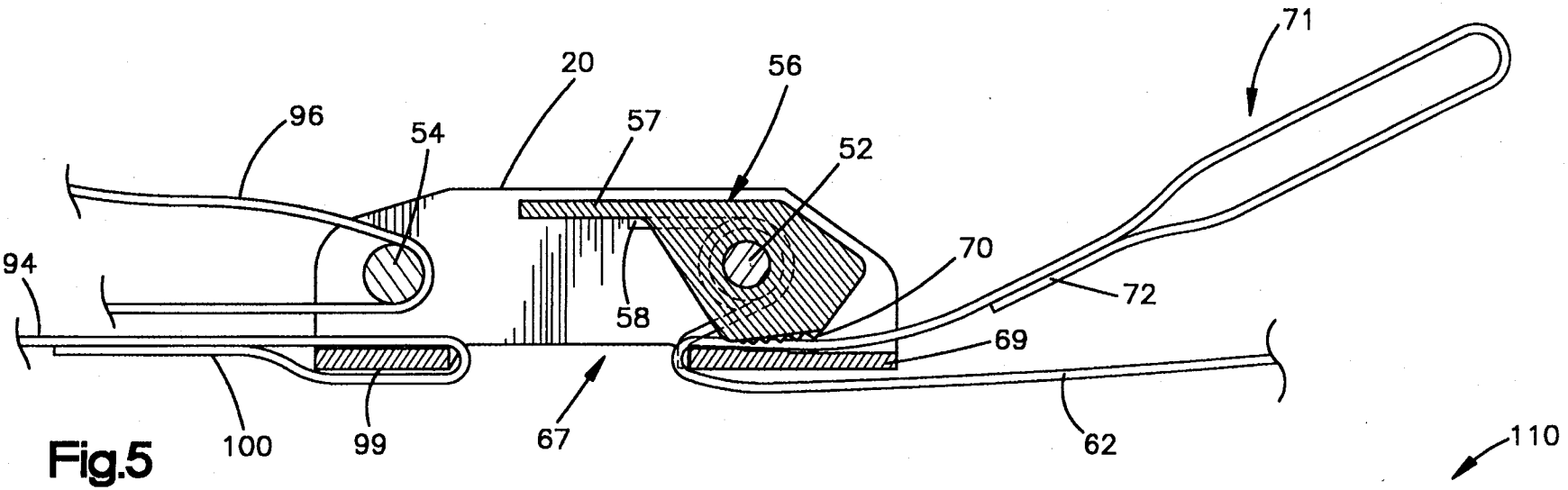
FIG. 5 is an enlarged cross-sectional view of the first buckle for the tie-down device of FIG. 1.

Strap 62 extends through opening 67 formed in the bottom plate of the first buckle 20 and loops around the first flange 69 between the serrated teeth 70 of the release button 57 and the flange 69 (see, e.g., FIG. 5). The far end of strap 62 terminates in a loop or handle, indicated generally at 71, for easy grasping by the user. The loop or handle 71 can be formed by folding over a portion of the strap 62 and fastening the strap together at 72 such as by stitching or adhesive.

According to one aspect of this first embodiment, the second hook 16 is connected to the second buckle 22 by a short strap 80. Strap 80 preferably comprises a one inch wide nylon web which is one-sixteenth of an inch thick and also has a 4000 lb. test. The strap 80 has a first portion which extends through a ring or eyelet, indicated generally at 82, in the second hook 83, and is folded over on itself and secured at 84, such as by stitching or adhesives. Strap 80 extends through a steel ring or link 86 and is again secured to itself at 84, such as by stitching or adhesive. The strap 80 can also include a second portion which terminates in a handle or loop, indicated generally at 90. To form the loop 90, the end of strap 80 can be folded over and secured at 92 such as by using stitching or adhesives. The loop 90 is optional with the present invention, but along with hook 16, provides a cinch which enables at least one end of the tie-down device to be "soft" attached to places on a vehicle. A similar loop could also be formed with first hook 14.

The mechanical advantage of the buckle assembly 12 is provided by a third strap 94 and a fourth, winch strap 96 which extend between and interconnect first buckle 20 and second buckle 22. Third strap 94 is connected at one end to flange 97 on the second buckle 22, such as by folding strap 94 around the flange 97 and securing the flange at 98 with stitching or adhesive (see, e.g., FIG. 6). Strap 94 then extends flat through ring 86 to a connection at its other end with second flange 99 of first buckle 20 (see, e.g., FIG. 5). Third strap 94 is preferably folded around flange 99 and connected at 100 such as by stitching or adhesives.

The fourth, winch strap 96 is connected at one end proximate to the second buckle 22 by being connected by stitching or adhesive to the third strap at 98. The winch strap 96 extends flat around roller 54 in buckle 20 and through the bottom plate opening 101 in second buckle 92. The winch strap then extends between the flange 102 of the buckle and the serrated teeth 103 of the release button 61. The fourth strap 96 terminates in a handle or loop, indicated generally at 110, which can be formed by folding over the end portion of the strap and securing the strap at 112 such as by stitching or adhesive.

The use of the tie-down device of the first embodiment will now be briefly described. Initially, the first hook 14 and the second hook 16 are connected to appropriate structure on the vehicle or trailer. The tie-down device extends over the load with the take-up strap 62 having a sufficient amount of slack for ease of attachment. The handle or loop 71 on the take-up strap 62 is then grasped and pulled to initially take up any slack in the take-up strap across the load. The first buckle is thereby brought closer to the first hook by pulling on the take-up strap loop, which thereby acts to bring the two hooks together with a limited amount of force. The handle or loop 110 of winch strap 96 is then grasped and pulled by the user to further tighten the tie-down device across the load. As should be apparent, strap 94 easily passes through ring 86, and in particular against one side or "bar" of the rod, as the tie-down device is being tightened, while strap 96 easily passes around roller 54 in buckle 20. The first and second buckles are brought closer to each other by pulling on the winch strap loop, which thereby acts to bring the two hooks together with increased force.

By pulling strap 96, a constant mechanical advantage is created by virtue of strap 96 and strap 94 extending between and interconnecting buckle 20 and 22. This mechanical advantage is termed "3:1" because there are three straps effectively interconnecting the two buckles. For every three inches of pulling on winch strap 96, the buckles move together by one inch. In other words, for every one pound of force that the winch strap is pulled, three pounds of force are applied to bring the buckles together.

To loosen the tie-down device such that the load can be removed, the release button on either of buckles 20 or 22 is pressed such that the locking mechanism for the particular buckle is released. As should be apparent, by pressing release button 61 on buckle 22, a short amount of strap will be released, while pressing release button 61 on buckle 20, a larger portion of strap to be released. In either case, the locking mechanisms provide a controlled release of the straps such that the first hook 14 and second hook or loop 16 can be easily uncoupled from the vehicle, and the tie-down device can be removed. Moreover, the controlled release of the buckles enables only a small amount of a strap to be released, if desired, such that minor adjustments of the load can be made, or such that the straps can be moved across the load to a more desirable location.

Figure 7:
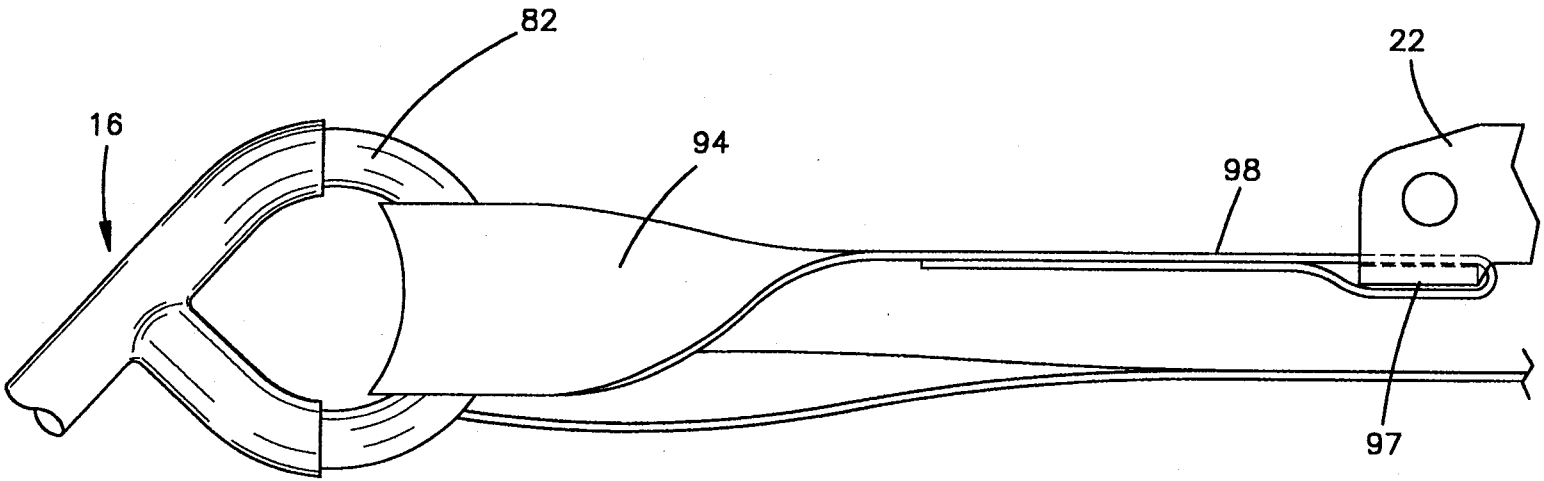
FIG. 7 is an enlarged view of another aspect of the first embodiment of the present invention, illustrating a strap extending directly through an eyelet in the hook of the tie-down device.

According to a second aspect of the first embodiment, as illustrated in FIG. 7, the third strap 94 can extend from its connection around flange 97 on second buckle 22 directly through the eyelet 82 formed in hook 16. Strap 94 would then extend to its connection with flange 99 on first buckle 20 as described previously. In this aspect, strap 94 passes freely through the eyelet 82, and the ring 86 and handle or loop 90 described previously are not necessary. The operation of the tie-down device in the second embodiment is the same as in the first embodiment and will not be discussed herein for sake of brevity.

Figure 9:
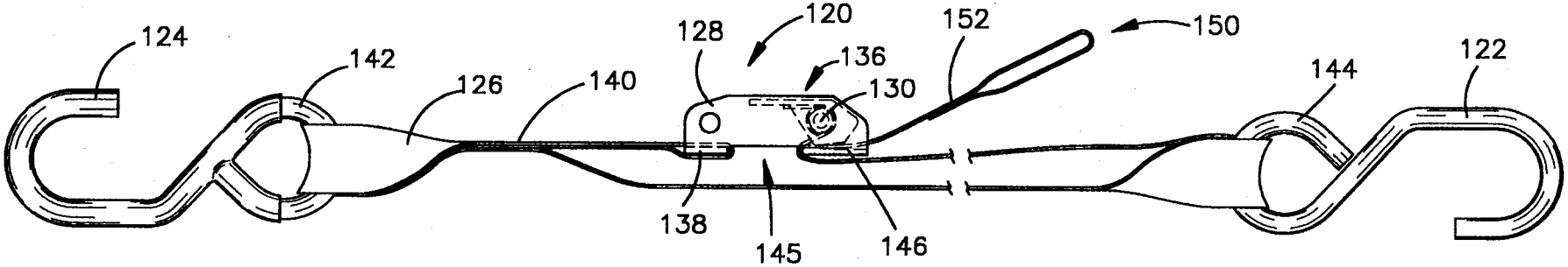
FIG. 9 is a side view of the tie-down device of FIG. 8, with portions shown in cross-section.
Figure 8:
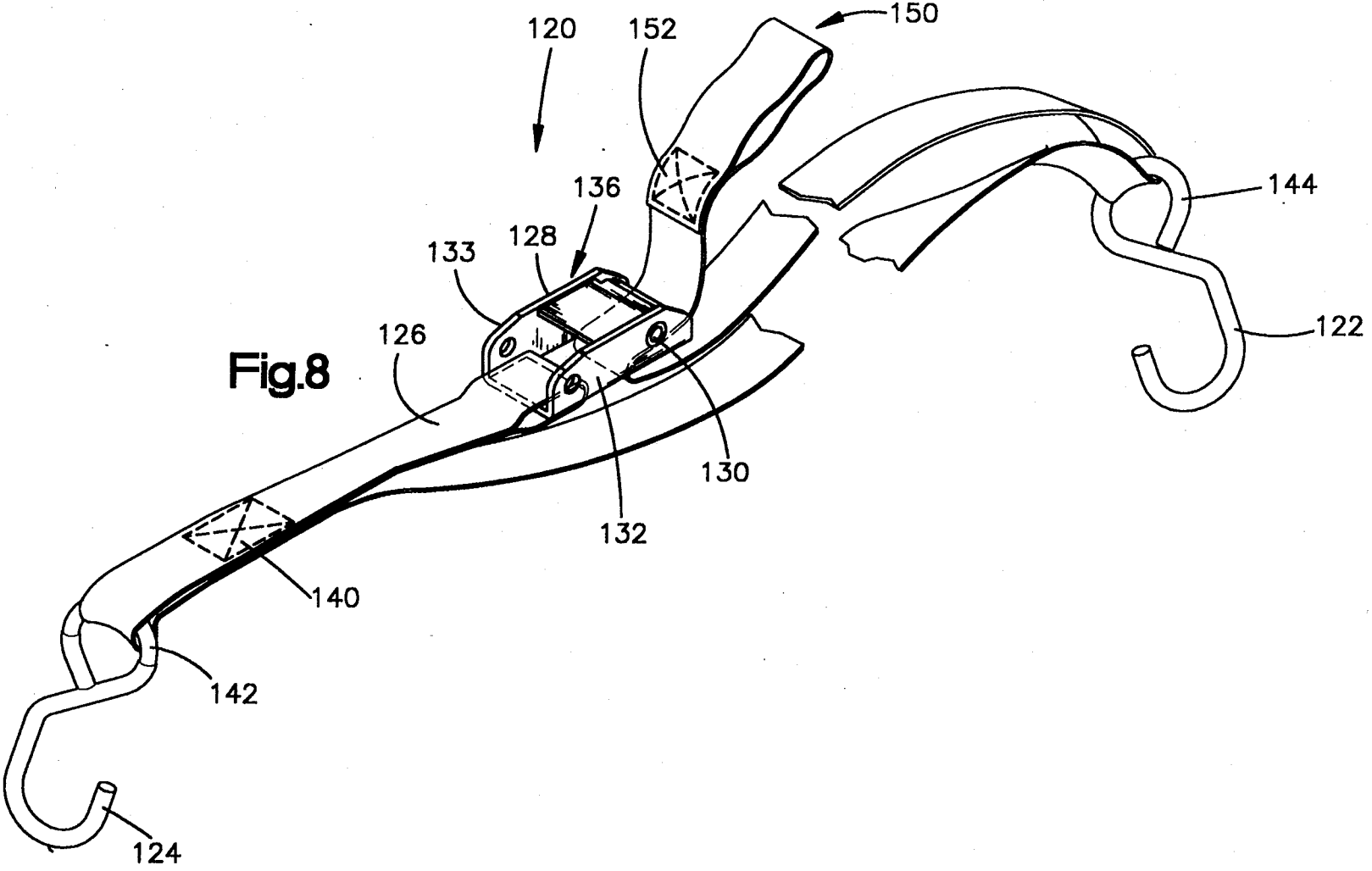
FIG. 8 is a perspective view of a tie-down device constructed according to a second embodiment of the present invention.

Referring now to FIGS. 8 and 9, a second embodiment of the present invention is illustrated. The tie-down device of the second embodiment is indicated generally at 120, and also provides a mechanical advantage for the user. In the second embodiment, the mechanical advantage is a constant "2:1".

According to the second embodiment, first and second hooks 122, 124, are used which can be formed in the same manner as described previously. A single strap 126 extends between and interconnects first hook 122, second hook 124 and a buckle 128. Buckle 128 is also formed in the same manner as described previously and preferably includes a first bar or rivet 130 extending between and interconnecting opposing apertures formed in the side walls 132, 133, of the buckle. A locking mechanism, indicated generally at 136, is located on the first bar 130 and includes a release button and a spring, such as described previously with respect to the first embodiment.

The first strap 126 is connected to flange 138 on buckle 128 such as by folding strap 126 around flange 138 and securing the strap at 140 by stitching or adhesive. Strap 126 then extends through ring or eyelet 142 formed in hook 124 and is again folded over and secured to itself at 140 by stitching or adhesive. Strap 126 then extends through ring or eyelet 144 formed in first hook 122, and moves freely therethrough. Strap 126 then extends through opening 145 formed in the bottom plate of buckle 128 and extends between flange 146 and locking mechanism 136. Strap 126 finally terminates in a handle or loop, indicated generally at 150, for grasping by the user. The handle or loop 150 can be formed by folding over strap 126 and fastening the strap together at 152 by stitching or adhesive.

The use of the tie-down device of the second embodiment should also be apparent to those skilled in the art. Initially, first hook 122 and second hook 124 are coupled to appropriate structure on the vehicle. Thereafter, handle or loop 150 is grasped and pulled to take up any slack in strap 126 and to tighten the strap over the load to secure the load to the vehicle. Because the strap 126 includes two strap segments extending from first hook 122 and the buckle 128, the mechanical advantage of the tie-down device of this embodiment is "2:1". In other words, for each two inches of pulling on the strap, the hooks will come together one inch.

As described above, the tie-down device of the present invention provides an easy and effective manner for securing cargo to a vehicle without the use of gears or ratchets. The tie-down device of either embodiment described above provides a mechanical advantage which results in increased tension being applied to the strap to tightly secure a load to a vehicle, but which can be easily manipulated to remove the tie-down device when necessary.

Although the invention has been described in its preferred form with a certain degree of particularity, it is understood that the present disclosure has been by way of example, and that numerous changes in the details of construction and the combination and arrangements of parts may be resorted to without departing from the spirit and scope of the invention as hereinafter claimed, For example, the mechanical advantage of the present invention can be increased beyond the 2:1 and 3:1 examples described above. Following the principles of the present invention, additional lengths of strap could extend between the two buckles in the first embodiment, such as by introducing additional blocks between the side walls of the buckles. By having the straps extend more than three times between the buckles, 5:1, 6:1 or greater mechanical advantage can be achieved. In any case, it is intended that the patent shall cover, by suitable expression in the appended claims, whatever features of patentable novelty exists in the invention disclosed.

What is claimed is:

1. An apparatus for tightening down a load on a vehicle, comprising:

a first connection device designed to be attached to a first location on the vehicle, a second connection device designed to be attached to a second location on the vehicle, a buckle assembly for adjusting the distance between the first and second connection devices, said buckle assembly including: i) first and second buckles, ii) a first strap connected at one end to said first buckle, at the other end to said second buckle, and extending around a ring on said first connection device; and iii) a second strap separate from said first strap connected at one end to said first strap proximate to said first buckle, and then extending around a first block on said second buckle and then through a first block on said first buckle for grasping and pulling by the user, wherein when said second strap is pulled by the user, said first buckle is pulled toward said second buckle, and a third strap interconnecting said second buckle and said second connection device.

2. The apparatus as in claim 1, wherein said first buckle has a releasable locking mechanism on said first block for engaging and disengaging said second strap.

3. The apparatus as in claim 2, wherein said third strap extends around a second block on said second buckle for grasping and pulling by the user, wherein when said third strap is pulled by the user, said second buckle is pulled toward said second connection device.

4. The apparatus as in claim 3, wherein said second buckle includes a releasable locking mechanism on said second block for engaging and disengaging said third strap.

5. The apparatus as in claim 4, wherein each of said first and second buckles include an outer housing supporting the releasable locking mechanism, the releasable locking mechanism including a release button and a spring normally biasing said release button into a locked position so as to engage a strap, and enabling said release button to be manually manipulated into an open position to disengage the strap.

6. The apparatus as in claim 5, wherein said second strap and said third strap each include a loop at one end for grasping by the user.

7. The apparatus as in claim 1, wherein said first connection device comprises a hook having a portion which forms the ring.

8. The apparatus as in claim 1, wherein said first connection device comprises a hook with an eyelet, and an additional strap interconnects the eyelet of the hook with the ring.

9. The apparatus as in claim 8, wherein the additional strap has a portion which forms a loop.

10. The apparatus as in claim 1, wherein each of said first and second buckles includes a flange, and said first strap is connected at the one end to the flange on the first buckle, and at the other end to the flange on the second buckle.

11. The apparatus as in claim 10, wherein said second strap is connected at the one end to said first strap proximate to said flange on said first buckle.

12. An apparatus for tightening down a load on a vehicle, comprising:

a first connection device designed to be attached to a first location on the vehicle, a second connection device designed to be attached to a second location.

a buckle assembly for adjusting the distance between the first and second connection devices, said buckle assembly including: i) first and second buckles, ii) a first strap connected at one end to said first buckle, at the other end to said second buckle, and extending around a ring on said first connection device; and iii) a second strap separate from said first strap connected at one end to said first strap proximate to said first buckle, and then extending around a first block on said second buckle and then through a first block on said first buckle for grasping and pulling by the user, said second strap having an end which can be grasped and pulled by the user to bring said first and second buckles together, and to therefore bring the first connection device toward the second connection device, said first buckle having a releasable locking mechanism on said first buckle for engaging and disengaging said one strap, a third strap interconnecting said second buckle and said second connection device and extending through a block on said second buckle, said second buckle having a releasable locking mechanism on said second buckle for engaging and disengaging said third strap.

* * * * *